US011498794B2

(12) United States Patent
Kashiba et al.

(10) Patent No.: US 11,498,794 B2
(45) Date of Patent: Nov. 15, 2022

(54) STACKING DEVICE AND METHOD FOR SORTING

(71) Applicant: Horizon International Inc., Takashima (JP)

(72) Inventors: Masayuki Kashiba, Takashima (JP); Tomoyuki Shimizu, Takashima (JP)

(73) Assignee: Horizon International, Inc., Takashima (JP)

( * ) Notice: Subject to any disclaimer, the term of this patent is extended or adjusted under 35 U.S.C. 154(b) by 18 days.

(21) Appl. No.: 17/075,425

(22) Filed: Oct. 20, 2020

(65) Prior Publication Data

US 2021/0114837 A1 Apr. 22, 2021

(30) Foreign Application Priority Data

Oct. 21, 2019 (JP) ..... JP2019-191750

(51) Int. Cl.
*B65H 5/32* (2006.01)
*B65H 39/10* (2006.01)
*B65H 29/18* (2006.01)

(52) U.S. Cl.
CPC ..... *B65H 39/10* (2013.01); *B65H 29/18* (2013.01)

(58) Field of Classification Search
CPC . B65H 5/32; B65H 5/34; B65H 39/10; B65H 29/18
USPC ..... 270/52.09, 52.17, 52.26, 52.29
See application file for complete search history.

(56) References Cited

U.S. PATENT DOCUMENTS 4,133,523 A 1/1979 Berthelot
4,289,052 A 9/1981 Woolston et al.
6,363,851 B1 * 4/2002 Gerhard ..... B41F 17/02 101/483
6,994,337 B1 2/2006 Cracknell et al.
7,261,507 B2 * 8/2007 Horii ..... B65H 39/02 412/35
7,354,233 B2 * 4/2008 Oki ..... B42C 5/00 270/52.14

(Continued)

FOREIGN PATENT DOCUMENTS

EP 1331105 A 7/2003
JP 2002-200865 A 7/2002
JP 2003-326495 A 11/2003

OTHER PUBLICATIONS

European Search Report in corresponding application 20200759.7 dated Apr. 20, 2021.

*Primary Examiner* — Patrick H Mackey
(74) *Attorney, Agent, or Firm* — Muncy, Geissler, Olds & Lowe, P.C.

(57) ABSTRACT

A pair of conveyance rollers are arranged for signatures. The signatures is conveyed through the pair of conveyance rollers to a stacking unit while being sandwiched from both sides thereof between the pair of conveyance rollers. In response to passage of a signature for a sheet stack through the pair of the conveyance rollers, the conveyance rollers is switched from conveyance rotation to intermittent rotation to cause the pair of the conveyance rollers to keep the signatures for a next sheet stack from being conveyed to the stacking unit. In response to the stacking unit becoming ready to receive the signatures for the next sheet stack, the conveyance rollers is switched from the intermitted rotation or the stop to the continuous rotation to cause the pair of the conveyance rollers to convey to the signatures to the stacking unit.

15 Claims, 7 Drawing Sheets

(56) References Cited

U.S. PATENT DOCUMENTS

| | | | | |
|---|---|---|---|---|
| 7,775,509 | B2 * | 8/2010 | Langenegger | B65H 39/105 270/21.1 |
| 10,960,701 | B2 * | 3/2021 | Ida | B42C 19/08 |
| 2002/0042333 | A1 | 4/2002 | Boss | |
| 2014/0005022 | A1 | 1/2014 | Iida | |
| 2021/0114831 | A1 * | 4/2021 | Kashiba | B65H 29/14 |

* cited by examiner

FIG. 5A
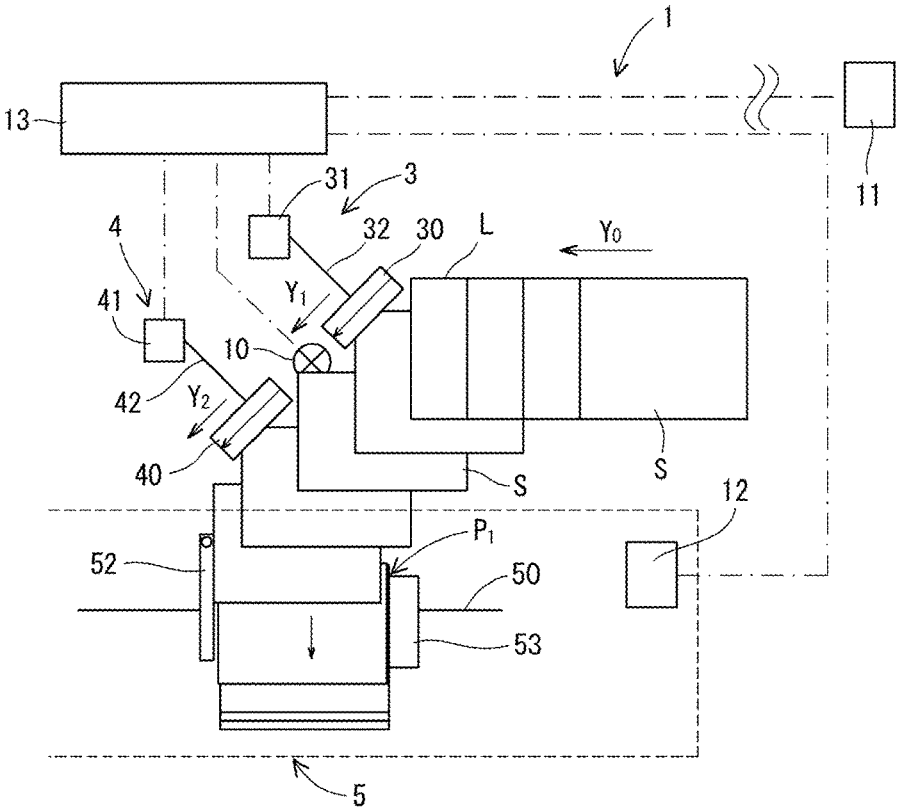
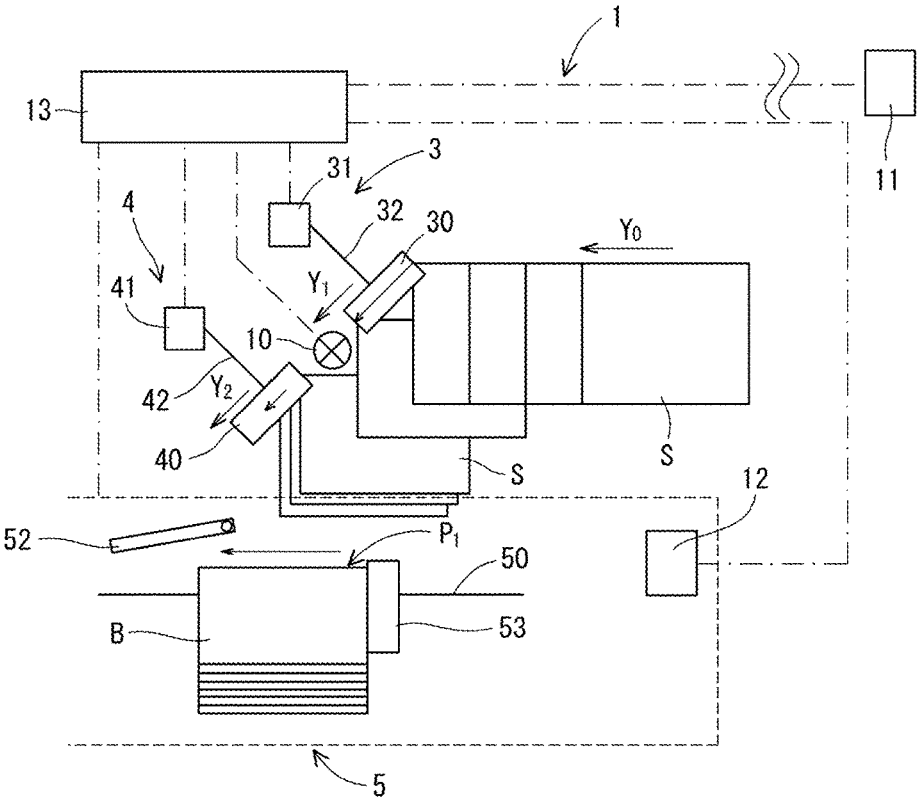
FIG. 5B

STACKING DEVICE AND METHOD FOR SORTING

This application claims the benefit of foreign priority to Japanese patent application serial No. 2019-191750, filed on Oct. 21, 2019, which is incorporated by reference herein in its entirety.

BACKGROUND OF THE INVENTION

Field of the Invention

The present disclosure relates to a stacking device for stacking signatures to form a sheet stack. The present disclosure also relates to a method for sorting signatures into sheet stacks.

Description of the Background Art

Saddle stitch binding systems disclosed in Japanese Unexamined Patent Application Publication No. 2003-326495 and Japanese Unexamined Patent Application Publication No. 2002-200865 fold printed sheets into signatures, stack a number of the signatures corresponding to a booklet to form a sheet stack, and then stitch the sheet stack.

The binding system disclosed in Japanese Unexamined Patent Application Publication No. 2003-326495 includes a stacking part. The stacking part stacks a number of signatures corresponding to a booklet at a predetermined stacking position to form a sheet stack, and conveys the sheet stack from the stacking position to a sheet stitching part. In order to accurately sort the signatures into the sheet stacks, while the stacking part conveys the sheet stack from the stacking position, the signatures for the next sheet stack have to be kept from being conveyed to the stacking position. Consequently, conveyance of all signatures or sheets upstream of the stacking device may be temporarily stopped, which results in significant reduction in processing speed.

The binding system disclosed in Japanese Unexamined Patent Application Publication No. 2002-200865 first conveys sheets successively using a conveyance device to an accumulation device to form a pile of sheets in the accumulation device. The binding system then pulls out a lowermost sheet of the pile of sheets one after another using grip means, folds the respective sheets in halve into signatures, and then conveys the signatures to a knife. The binding system stacks the signatures on the knife in a straddling manner. The binding system then retracts the knife using a cylinder to drop the stacked signatures onto a collating chain, and then conveys them to a stitching device using the collating chain and an entrainment member.

This binding system forms the pile of sheets, thereby eliminating the need for stopping continuous conveyance of the sheets by the conveyance device. However, it takes time to pulls out a lowermost sheet of the pile of sheets one after another using the grip means. Further, since the knife is retracted to drop the stacked signatures, time is required to reciprocate the knife by a stroke corresponding to the length of the signature. This can lead to a reduction in productivity of the binding system.

SUMMARY OF THE INVENTION

An object of the present disclosure is to provide a device and a method which allow for sequentially forming sheet stacks at high speed.

According to an aspect of the present disclosure, there is provided a stacking device for stacking signatures, including: a first conveyance unit configured to sequentially convey the signatures; a second conveyance unit comprising a pair of conveyance members arranged for receiving the signatures from the first conveyance unit, at least one of the conveyance members (conveyor) being configured to be driven to rotate, the second conveyance unit being configured to convey the signatures through the pair of conveyance members by means of rotation of the pair of conveyance members while sandwiching both sides of the signatures between the pair of conveyance members; a stacking unit configured to stack the signatures conveyed from the second conveyance unit; a first sensor configured to detect the signatures that have passed through the pair of conveyance members; a second sensor configured to detect when the stacking unit is ready to receive the signatures; and a controller configured to control rotation of the at least one of the conveyance members based on a feedback from the first sensor and a feedback from the second sensor.

When it is determined based on the feedback from the first sensor that a predetermined number of the signatures have passed the pair of conveyance members, the controller is configured to switch the conveyance members from continuous rotation to intermittent rotation or stop. When the conveyance members are in intermittent rotation or stopped, the controller is configured to convey the signatures stacked in the stacking unit. When the conveyance members are in intermittent rotation or stopped, and when it is determined based on the feedback from the second sensor that the stacking unit has become ready to receive the signatures, the controller is configured to switch the conveyance members from the intermittent rotation or stop to the continuous rotation.

When the controller switches the conveyance members from the continuous rotation to the intermittent rotation, the pair of conveyance members, for example, by means of the intermittent rotation, receive the signatures for the next sheet stack from the first conveyance unit and hold the signatures for the next sheet stack by sandwiching the signatures for the next sheet stack so as to keep the signatures for the next sheet stack from being conveyed to the stacking device.

When the controller switches the conveyance members from the continuous rotation to the stop, the pair of conveyance members, for example, by means of the stop of rotation, hold at least first signature for the next sheet stack by sandwiching the at least first signature such that subsequent signatures are placed on the at least held first signature.

The pair of conveyance members may be a pair of conveyance rollers or a pair of conveyance belts.

The first sensor may include: a signature sensor arranged to detect passage of the signatures at a position downstream of the first conveyance unit and upstream of the second conveyance unit; and a mark sensor arranged to detect marks on the signatures at a position upstream of the first conveyance unit.

The first sensor may include a mark sensor arranged to detect marks on the signatures at a position upstream of the pair of conveyance rollers.

The first conveyance unit may be configured to convey the signatures diagonally downwards with a fold line of each of the signatures oriented upward. Further, the second conveyance unit may be configured to covey the signatures diagonally downwards.

The stacking unit may include an endless chain or belt extending across the stacking position and defining a conveyance path for the sheet stacks. The signatures may be conveyed from the second conveyance unit to the stacking position to be stacked on the endless chain or belt in a straddling manner. The sheet stack may be conveyed along the conveyance path by means of rotation of the endless chain or belt in a straddling state.

The second sensor may include a sensor arranged to detect rotation of the endless chain or belt.

According to another aspect of the present disclosure, there is provided a method for sorting signatures into sheet stacks, wherein the signatures are sequentially conveyed by a first conveyance unit to a second conveyance unit including a pair of conveyance members at least one which is configured to be driven to rotate, the method including: sequentially conveying the signatures through the pair of conveyance members to a stacking unit while sandwiching the signatures between the pair of conveyance members by means of continuous rotation of the conveyance members; in response to passage of a last signature for a sheet stack through the pair of conveyance members, switching the conveyance members from the continuous rotation to intermittent rotation or stop to cause the pair of conveyance members to keep the signatures for a next sheet stack from being conveyed to the stacking unit; and in response to the stacking unit becoming ready to receive the signatures for a next sheet stack, switching the conveyance members from the intermittent rotation or stop to the continuous rotation to cause the pair of conveyance members to convey the signature for the next sheet stack to the stacking unit.

The method may include: in response to the passage of the last signature for the sheet stack through the pair of conveyance members, switching the conveyance members from the continuous rotation to the intermittent rotation to cause the pair of conveyance members to, by means of the intermittent rotation, receive the signatures for the next sheet stack from the first conveyance unit and to hold the signatures for the next sheet stack by sandwiching the signatures for the next sheet stack so as to keep the signatures for the next sheet stack from being conveyed to the stacking device.

The method may include: in response to determining that the last signature for the next sheet stack has passed through the pair of conveyance members, switching the conveyance members from the continuous rotation to the stop to cause the pair of conveyance members to, by means of the stop of rotation, hold at least first signature for the next sheet stack by sandwiching the at least first signature such that subsequent signatures are placed on the at least held first signature.

A pair of conveyance rollers or a pair of conveyance belts may be used as the pair of conveyance rollers.

The device and the method of the present disclosure enables sheet stacks to be sequentially formed at high speed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 5A illustrates stacking of sheets, and FIG. 5B illustrates conveyance of a sheet stack.

DETAILED DESCRIPTION

Figure 1:
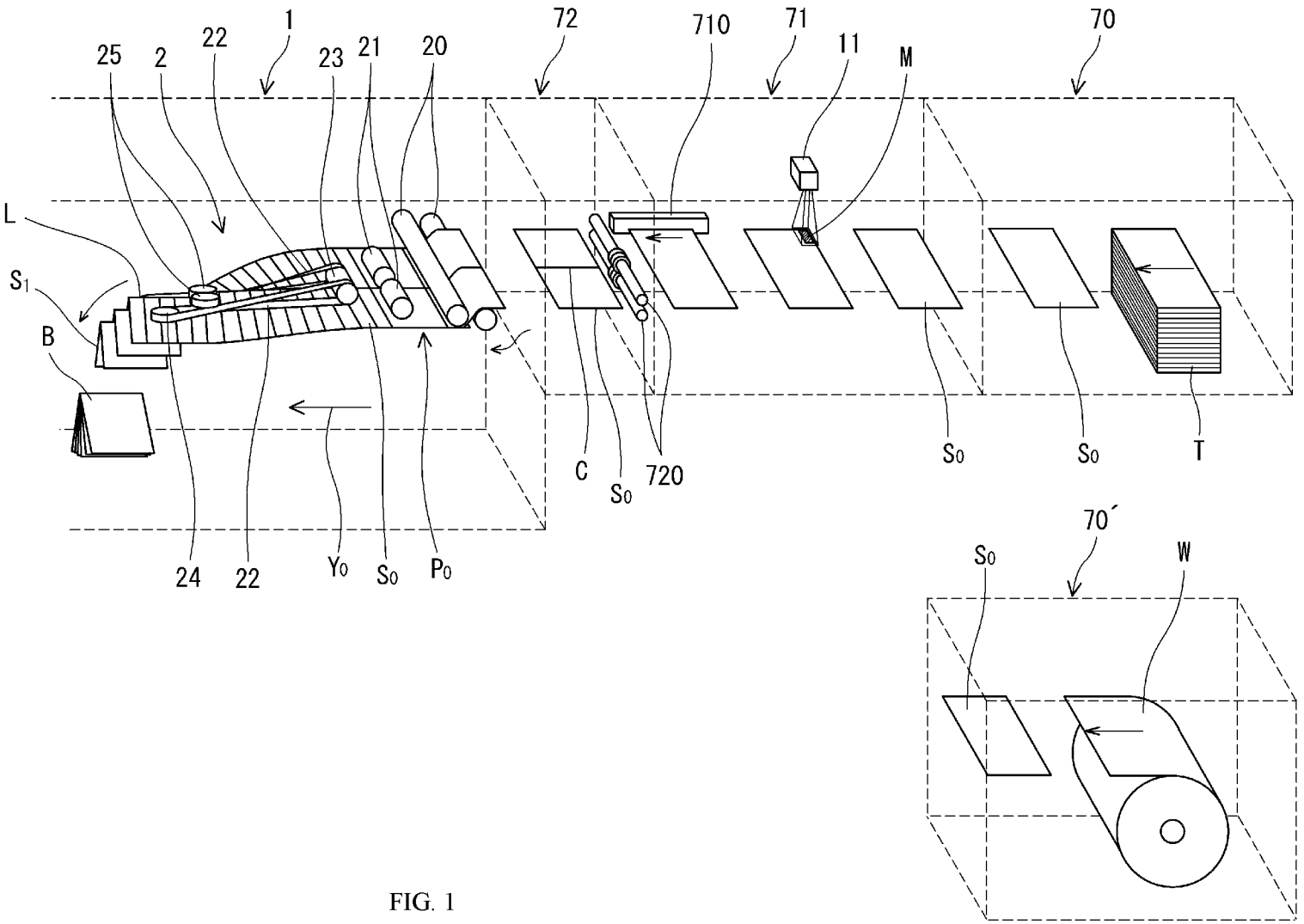
FIG. 1 is a partial and schematic view of an exemplary binding system.

Exemplary embodiments will be described, wherein like reference numerals designate corresponding or identical elements throughout the various drawings.

FIG. 1 is a schematic view of an upstream section of a binding system. More specifically, the binding system is a saddle stitch binding system. The binding system includes a sheet feeder 70 configured to feed sheets $S_0$, a conveyance device 71 configured to convey the sheets $S_0$, a creasing device 72 configured to crease the sheets $S_0$ and a stacking device 1 configured to stack a predetermined number of signatures $S_1$ (in this embodiment, a number of the signatures $S_1$ corresponding to a booklet) to form a sheet stack B.

The sheet feeder 70 feeds the sheets $S_0$ one by one from a large stack T to the conveyance device 71. For digital printing, the sheet feeder 70 may include a printer (not shown) configured to print the sheets $S_0$ in order to feed the printed sheets $S_0$. Alternatively, the sheet feeder 70 may feed the sheets $S_0$ that have been printed in advance. Instead of the sheet feeder 70, a sheet feeder 70' may cut a web W using a cut device to make sheets $S_0$ from the web W, and feed the sheets $S_0$. The web W or the sheets $S_0$ may be printed by a printer. Alternatively, the web S that has been printed in advance may be used.

The conveyance device 71 receives the sheets $S_0$ from the sheet feeder 70 and conveys the sheets $S_0$ to the creasing device 72. The conveyance device 71 includes a conveyor (not shown) having a conveyance surface extending in a conveyance direction and configured to convey the sheets $S_0$ which are placed on the conveyance surface. The conveyance device 71 of the embodiment further includes a reference guide 710 extending parallel to the conveyance direction. The conveyor conveys each sheet $S_0$ obliquely toward the reference guide 710 such that a side edge of the sheet $S_0$ comes into contact with the reference guide 710 over its entire length during conveyance, causing the skew of the sheet $S_0$ to be corrected. Each sheet $S_0$ is conveyed to the creasing device 72 with the skew thereof corrected.

The creasing device 72 receives the sheets $S_0$ from the conveyance device 71, creases each sheet $S_0$ to form a crease C on the sheet $S_0$, and conveys the sheets $S_0$ to the stacking device 1. The creasing device 72 includes a pair of creasing rollers 720. The creasing device 72 conveys each sheet $S_0$ through the pair of creasing rollers 720 to form on the sheet $S_0$ the crease C extending in the conveyance direction. The creasing device 72 then conveys each sheet $S_0$ to the stacking device 1.

The stacking device 1 includes the upstream conveyance unit 2. The upstream conveyance unit 2 is configured to receive the sheets $S_0$ from the creasing device 72 and to successively and horizontally convey the sheets $S_0$ with the sheets $S_0$ partially overlapped with one another. The upstream conveyance unit 2 is further configured to fold each sheet $S_0$ in a conveyance direction $Y_0$, more particularly along its crease C, into a signature $S_1$ during conveyance and to convey the signatures $S_1$ with the signatures $S_1$ partially overlapped with one another. The reference $Y_0$ in FIG. 1 designates a horizontal conveyance direction of the upstream conveyance unit 2. In the upstream horizontal unit 2, each of the sheets $S_0$ or signatures $S_1$ is partially overlapped with the next sheet $S_0$ or signature $S_1$ from above. In other words, each of the sheets $S_0$ or signatures $S_1$ is superposed on the previous sheet $S_0$ or signature $S_1$ to be shifted in the direction opposite to the conveyance direction $Y_0$.

In order to achieve this, the upstream conveyance unit 2 includes a pair of guide rollers 20 for guiding the sheets $S_0$ to an overlapping position $P_0$ which is used for partially overlapping the sheets $S_0$, and a feed roller 21 arranged at the overlapping position $P_0$ for feeding the sheets $S_0$ from the overlapping position $P_0$. These rollers 20 and 21 are rotatable about an axis extending in the horizontal direction which is perpendicular to the conveyance direction $Y_0$.

Each of the sheets $S_0$ is guided by the pair of guide rollers 20 from the creasing device 72 to the overlapping position $P_0$, and then fed by the feed roller 21 from the overlapping position $P_0$ in the conveyance direction $Y_0$. As the sheet $S_0$ is guided to the overlapping position $P_0$, rotation of the feed roller 21 is controlled to cause the sheet $S_0$ to partially overlap on the previous sheet $S_0$ from above. Repeating this enables the sheets $S_0$ to be conveyed in a partially overlapped state.

The upstream conveyance unit 2 further includes two conveyance belts 22, an upstream pulley 23, and two downstream pulleys 24 (one of which is not shown). The upstream pulley 23 is rotatable about an axis extending in the horizontal direction which is perpendicular to the conveyance direction $Y_0$. The two downstream pulleys 24 are spaced from each other in the horizontal direction which is perpendicular to the conveyance direction $Y_0$. Each of the pulleys 24 is rotatable about an axis extending vertically. One of the conveyance belts 22 is engaged with the upstream pulley 23 and one of the downstream pulleys 24 to extend therebetween. The other conveyance belt 22 is engaged with the upstream pulley 23 and the other downstream pulley (not shown) to extend therebetween.

The upstream conveyance unit 2 further includes a pair of fold rollers 25 located between the two conveyance belts 22. The fold rollers 25 are opposed to each other and are rotatable about an axis extending vertically.

The sheet $S_0$ that has been fed by the feed roller 21 is engaged with the two conveyance belts 22 which are being driven to rotate, so that the sheet $S_0$ is conveyed by the conveyance belts 22 in the conveyance direction $Y_0$. During this conveyance, the twists of the extending parts of the conveyance belts 22, which are being engaged with the sheet $S_0$, properly guide both side sections of the sheet $S_0$ downwardly and bend the sheet $S_0$ so as to form a top on the center of the sheet $S_0$. The top of the sheet $S_0$ is guided to the pair of fold rollers 25 to pass therethrough, so that the sheet $S_0$ is folded along a fold line L (along the crease C) extending in the conveyance direction $Y_0$. In this way, each of the sheets $S_0$ is fold in half into a signature $S_1$ during the conveyance.

Subsequently, the signatures $S_1$ are successively conveyed in a partially overlapped state and then conveyed out of the upstream conveyance unit 2 with the fold line L of each of the signatures $S_1$ oriented upward, the fold line L extending in the conveyance direction $Y_0$.

Although not shown, it will be appreciated by those skilled in the art that the upstream conveyance unit 2 includes at least one support for properly supporting the sheets $S_0$ or signatures $S_1$ from below during conveyance.

Figure 2:
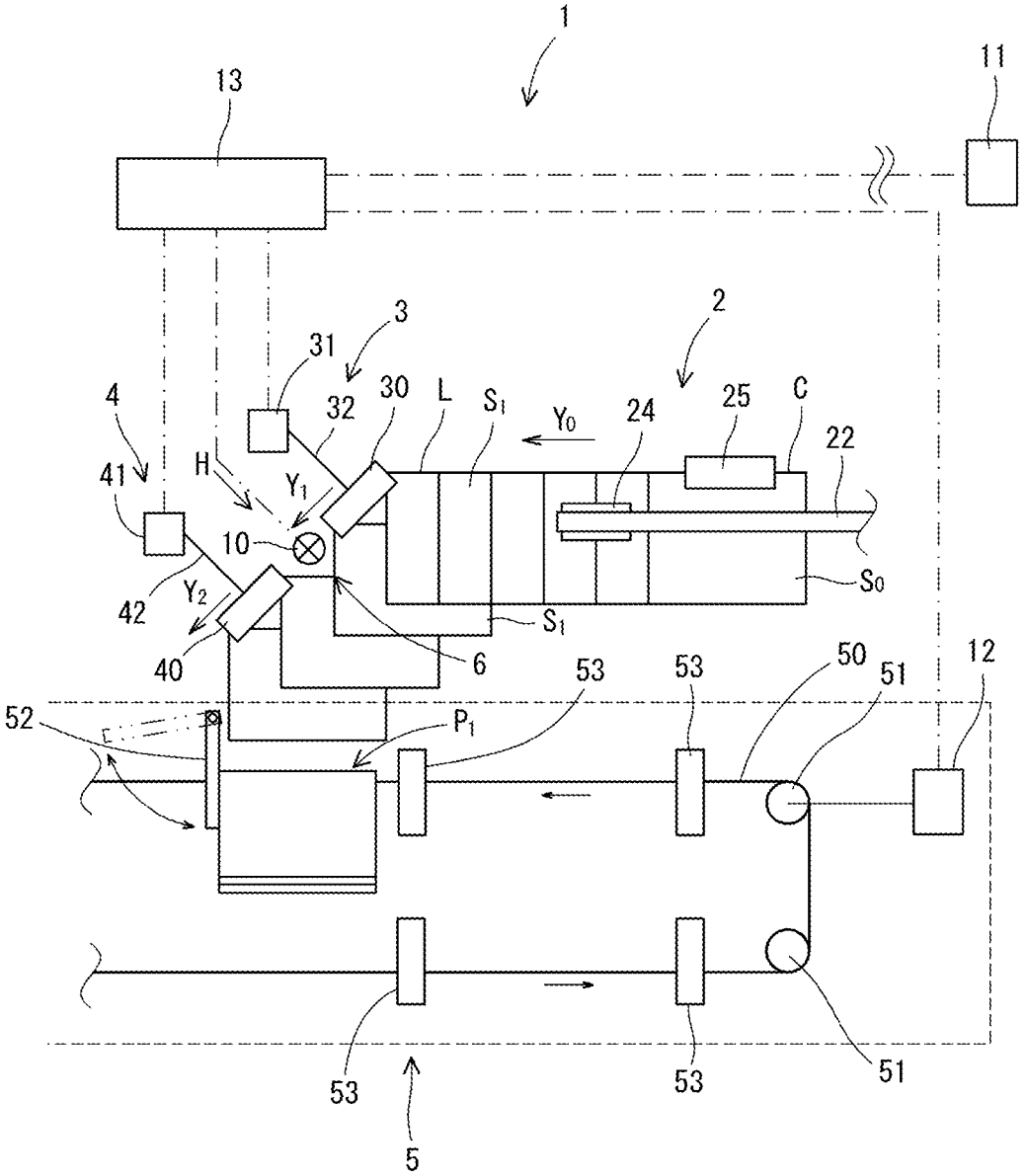
FIG. 2 is a partial and schematic view of an exemplary stacking device.

FIG. 2 illustrates an arrangement of the stacking device 1 downstream of the upstream conveyance unit 2. The stacking device 1 further includes a first conveyance unit 3 configured to receive the signatures $S_1$ conveyed out of the upstream conveyance unit 2 and to sequentially convey the signatures $S_1$. A reference $Y_1$ in FIG. 2 designates a conveyance direction of the first conveyance unit 3. In this embodiment, the conveyance direction $Y_1$ is an oblique downward direction.

Figure 3:
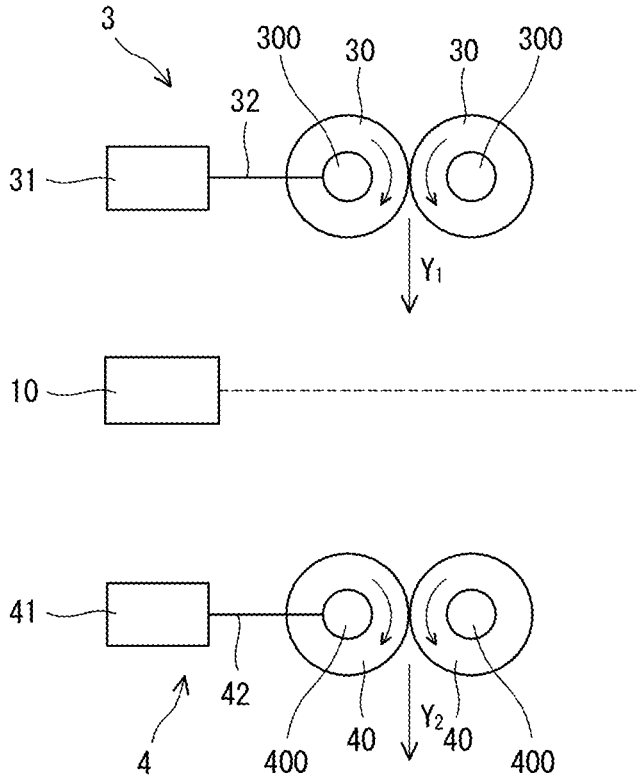
FIG. 3 is a schematic view of an exemplary stacking device as viewed from an arrow H in FIG. 2.

FIG. 3 is a view on arrow H in FIG. 2. The first conveyance unit 3 includes a pair of conveyance rollers 30 (as an example of a pair of conveyance members) arranged for receiving the signatures $S_1$ conveyed out of the upstream conveyance unit 2, a motor 31 as a drive source for rotary drive of at least one of the conveyance rollers 30, and a transmission mechanism 32 for transmitting drive force of the motor 31 to the at least one of the conveyance rollers 30.

The pair of conveyance rollers 30 are opposed to each other and are arranged to be rotatable, for example, about an axis extending perpendicularly to the oblique downward direction $Y_1$, which is the conveyance direction thereof. More specifically, each conveyance roller 30 has a rotation shaft 300 extending perpendicularly to the conveyance direction $Y_1$ and rotatably supported by a frame (not shown). The pair of conveyance rollers 30 are positioned so as to sandwich the front-upper section of each signature $S_1$ (see FIG. 2).

The transmission mechanism 32 is illustrated in a simplified manner since the transmission mechanism 32 has a well-known structure. For example, the transmission mechanism 32 connects the output shaft of the motor 31 to the rotation shaft(s) 300 of the conveyance roller(s) 30 to transmit the drive force of the motor 31 to the conveyance roller(s) 30. Both of the conveyance rollers 30 may be driven to rotate. Alternatively, the first conveyance roller 30 may be driven to rotate so that the second conveyance roller 30 can be dependently rotated in accordance with the rotation of the first conveyance roller 30.

The signatures $S_1$ that have been conveyed out of the upstream conveyance unit 2 are received by the pair of conveyance rollers 30 to be sandwiched from both sides thereof between the pair of conveyance rollers 30. The first conveyance unit 3 conveys the signatures $S_1$ in the conveyance direction $Y_1$ through the pair of conveyance rollers 30 by means of rotation of the pair the conveyance rollers 30 while sandwiching the signatures $S_1$ between the pair of conveyance rollers 30. In this embodiment, each of the signatures $S_1$ is diverted by the pair of conveyance rollers 30 from the horizontal direction $Y_0$ to the oblique downward direction $Y_1$. Therefore, the signatures $S_1$ that have been successively conveyed out of the upstream conveyance unit 2 are then successively conveyed in the oblique downward direction $Y_1$ by the first conveyance unit 3.

The stacking device 1 further includes a second conveyance unit 4 configured to receive the signatures $S_1$ from the first conveyance unit 3 and to covey the signatures $S_1$. A reference $Y_2$ in FIGS. designates a conveyance direction of the second conveyance unit 4 (see FIG. 2). In this embodiment, the conveyance direction $Y_2$ is the same oblique downward direction as the conveyance direction $Y_1$.

The second conveyance unit 4 includes a pair of conveyance rollers 40 (as an example of a pair of conveyance members) arranged for receiving the signatures $S_1$ conveyed out of the first conveyance unit 3. The pair of conveyance rollers 40 are opposed to each other. Each of the conveyance rollers 40 is arranged to be rotatable about an axis extending perpendicularly to the conveyance direction $Y_2$. More specifically, each conveyance roller 40 has a rotation shaft 400 extending perpendicularly and rotatably supported by a frame (not shown). The pair of conveyance rollers 40 are positioned so as to sandwich the front-upper section of each signature $S_1$ (see FIG. 2).

Like the first conveyance unit 3, the second conveyance unit 4 further includes a motor 41 as a drive source for rotary drive at least one of the conveyance rollers 40, and a well-known transmission mechanism 42 for transmitting the drive force of the motor 41 to the at least one of the conveyance rollers 40. At least one of the conveyance rollers 40 is driven to rotate by the motor 41 and the transmission mechanism 42.

The second conveyance unit 4 is configured to convey the signatures $S_1$ (which have been conveyed out of the first conveyance unit 3) through the pair of conveyance rollers 40 in the conveyance direction $Y_2$ by means of rotation of the pair of conveyance rollers 40 while sandwiching both sides of the signatures $S_1$ between the pair of conveyance rollers 40. In the embodiment, the conveyance direction $Y_2$ is the same oblique downward direction as the conveyance direction $Y_1$. The conveyance direction $Y_2$ may be different from the conveyance direction $Y_1$. Furthermore, the conveyance direction $Y_2$ is not limited to an oblique downward direction.

As illustrated in FIG. 2, the stacking device 1 further includes a stacking unit 5 configured to receive the signatures $S_1$ having the fold lines L oriented upward from the second conveyance unit 2, to stack a predetermined number of the signatures $S_1$ at a stacking position $P_1$ so as to form a sheet stack B (FIG. 1), and to convey the sheet stack B from the stacking position $P_1$.

The stacking unit 5 includes an endless chain or a belt 50 extending across the stacking position $P_1$ and defining a conveyance path for the sheet stacks B. The chain or belt 50 is engaged with sprockets or pulleys 51. The signatures $S_1$ are sequentially conveyed out of the second conveyance unit 4 to the stacking position $P_1$ and then stacked in a straddling manner on the chain or belt 50 at the stacking position $P_1$ to form a sheet stack B which consists of a predetermined number of the signatures $S_1$. Rotary drive of the chain or belt 50 causes the sheet stack B to be conveyed from the stacking position $P_1$ in a straddling state along the conveyance path. After the sheet stack B is conveyed from the stacking position $P_1$, the chain or belt 50 is stopped. Then, the signatures $S_1$ for the next sheet stack B are stacked at the stacking position $P_1$ on the chain or belt 50.

The stacking unit 5 further includes a stopper 52. The stopper 52 is arranged to be movable between a contact position (see the one drawn with a solid line) where the stopper 52 is located in the conveyance path for the sheet stacks B in front of the stacking position $P_1$ to keep the signatures $S_1$ or the sheet stack B from travelling from the stacking position $P_1$ by being in contact with the front ends of the signatures $S_1$ or the front end of the sheet stack B, and a retraction position (see the one drawn with the two-dot chain line) where the stopper 52 is retracted from the conveyance path to allow the sheet stack B to be conveyed from the stacking position $P_1$. The stopper 52 is configured to be moved (rotated) by a well-known movement mechanism.

The stacking unit 5 further includes entrainment members 53 arranged at appropriate intervals on the chain or belt 50. The entrainment members 53 are the same as those disclosed in Japanese Unexamined Patent Application Publication No. 2002-200865. Each of the entrainment members 53 is used to push and align the rear end of the sheet stack B in order to assist the conveyance of a sheet stack B.

The stacking device 1 further includes a first sensor used to determine when the last signature $S_1$ for the sheet stack B has passed through the pair of conveyance rollers 40. In the embodiment, a signature sensor 10 and a mark sensor 11 are each used as the first sensor.

Figure 4:
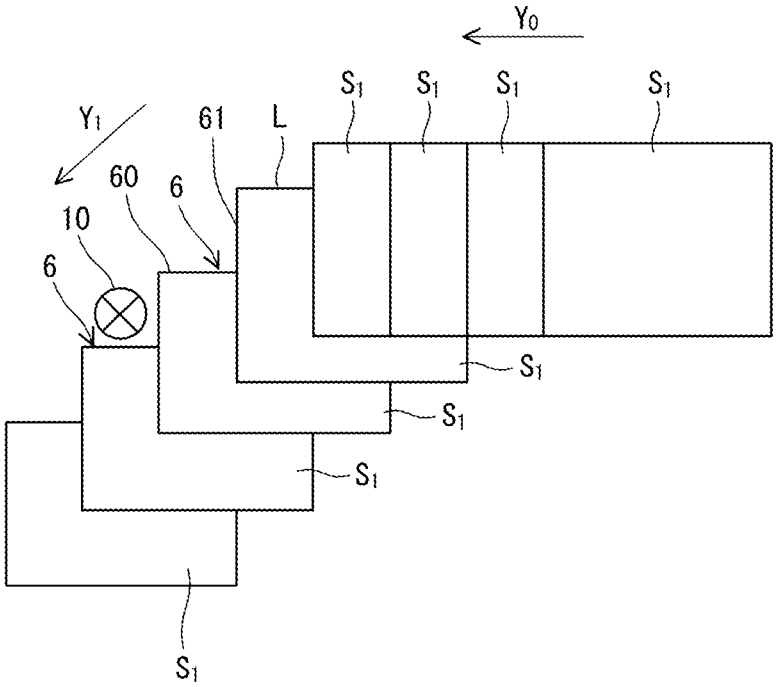
FIG. 4 is a view of an exemplary first sensor.

The signature sensor 10 is arranged to detect passage of the signatures $S_1$ at a position downstream of the first conveyance unit 3 (the pair of conveyance rollers 30) and upstream of the second conveyance unit 4 (the pair of conveyance rollers 40). The signature sensor 10 may be a sensor which detects the presence or absence of the signatures $S_1$, and may be an optical sensor such as a photoelectronic sensor. As illustrated in FIG. 4, steps 6 are formed. Each of the steps 6 is formed by two signatures $S_1$ adjacent to each other that have been diverted to the oblique downward direction $Y_1$ by the pair of conveyance rollers 30 (not shown in FIG. 4) and thereby are travelling in the oblique downward direction $Y_1$. The step 6 is formed by the upper edge 60 (the fold line L) of the signature $S_1$ and the front edge 61 of the next signature $S_1$.

No gap is formed between the signatures $S_1$ while the signatures $S_1$ are successively and horizontally conveyed in a partially overlapped state. In contrast, when the signature $S_1$ is diverted to the oblique downward direction $Y_1$ to be lowered relative to the next signature $S_1$, the step 6 is formed by these two signatures $S_1$ adjacent to each other. The step 6 creates a gap between the signatures $S_1$. The signature sensor 10 is arranged to detect passage of the signatures $S_1$ at the position where these steps 6 pass. The directional diversion of the signatures $S_1$ and the arrangement of the signature sensor 10 described above allow the signature sensor 10 to certainly detect passage of the signatures $S_1$ which are being successively conveyed, even though the signature sensor 10 is a simple sensor which detects the presence or absence of the signature $S_1$.

As illustrated in FIG. 1, at least one signature $S_1$ of each sheet stack B has a mark M thereon for determining the number of the signatures $S_1$ (sheets $S_0$) which form the sheet stack B. The mark sensor 11 is arranged to detect the marks M at a position upstream of the first conveyance unit 3. In the embodiment, the mark sensor 11 is arranged to detect marks M before the sheets $S_0$ are folded into the signatures $S_1$, more specifically, before the sheets $S_0$ are overlapped. The mark sensor 11 may be an optical sensor such as a camera or a code reader. In the embodiment, Marks M are one-dimensional codes or two-dimensional codes which are provided on the first or last signatures $S_1$ for the respective sheet stacks B and each indicates the number of the signatures 51 which form the sheet stack B.

As illustrated in FIG. 2, the stacking device 1 further includes a second sensor 12 used to detect when the stacking unit 5 has become ready to receive the signatures $S_1$. In this embodiment, the stacking unit 5 rotates the chain or belt 50 to convey the sheet stack B from the stacking position $P_1$ and then stop the chain or belt 50, which causes the stacking unit 5 to become ready to receive the signatures $S_1$ for a next sheet stack B. In other words, switching of the chain or belt 50 from rotation to stop indicates that the stacking device 5 becomes ready to receive the signatures $S_1$ for the next sheet stack B. Therefore, the second sensor 12 may be, for example, a rotary encoder connected to one of the sprockets or pulleys 51 to detect rotation of the chain or belt 50.

The stacking device 1 further includes a controller 13 configured to control the operation of each of the units 2 to 5. The controller 13 includes, for example, a processing circuitry. The processing circuitry includes, for example, a central processing unit (CPU), a main memory, and an auxiliary storage. The CPU reads a program stored in the auxiliary storage into the main memory to perform information processing and arithmetic processing, so that various controls can be achieved. Examples of the auxiliary storage include a magnetic disk, a magnetic optical disk, a CD-ROM, a DVD-ROM, and a semiconductor memory.

The controller 13 is connected to the respective sensors 10, 11 and 12. The controller 13 counts the number of the signatures $S_1$ that are conveyed from the first conveyance unit 3 to the second conveyance unit 4, based on the detection by the signature sensor 10 which is one of the first sensors. The controller 13 determines the number of the signatures $S_1$ which form each of the sheet stacks B, based on the detection by the mark sensor 11 which is one of the first sensors. Each of the signatures S1 passes through a pair of conveyance rollers 40 after a predetermined time from being detected by the signature sensor 10. Therefore, the controller 13 is capable of determining, based on the detections by the first sensors 10 and 11, that the last signature $S_1$ for the sheet stack B has passed through the pair of conveyance rollers 40. For example, when the number of signatures $S_1$ counted based on the feedback from the signature sensor 10, the result detected by the signature sensor 10, reaches a predetermined number, the controller 13 is capable of determining that the last signature $S_1$ for the sheet stack B has passed through the pair of conveyance rollers 40. Further, as described above, the controller 13 is capable of determining, based on the detection by the second sensor 12, that stacking unit 5 has become ready to receive the signatures $S_1$.

The controller 13 is electrically connected to the first conveyance unit 3 (the motor 31) to control rotation of the conveyance roller(s) 30 via the motor 31 and the transmission mechanism 32. The controller 13 is electrically connected to the second conveyance unit 4 (the motor 41) to control rotation of the conveyance roller(s) 40 via the motor 41 and the transmission mechanism 42. The controller 13 is electrically connected to the stacking unit 5 to control the operation of the stacking unit 5 such as the rotation of the chain or belt 50 and the movement of the stopper 52.

An exemplary operation of the stacking device 1 and an exemplary method for sorting will be described below. The controller 13 controls the rotation of the conveyance roller(s) 40 (as an example of a conveyance member(s)) based on the detections by the first sensors 10 and 11 and the detection by the second sensor 12. The controller 13 constantly keeps the conveyance roller(s) 30 continuously rotating. Thus, the first conveyance unit 3 sequentially conveys the signatures $S_1$ to the second conveyance unit 4.

As illustrated in FIG. 5A, the controller 13 continuously rotates the conveyance roller(s) 40 in order to stack the predetermined number of the signatures $S_1$ at the stacking position $P_1$. The signatures $S_1$ are sequentially conveyed by the pair of conveyance rollers 40 from the first conveyance unit 3 to the stacking unit 5. The signatures $S_1$ come into contact with the stopper 52 which is located at the contact position, and thus drop to the stacking position $P_1$. This causes the signatures $S_1$ to be stacked at the stacking position $P_1$ on the chain or belt 50 in a straddling manner.

As illustrated in FIG. 5B, when the number of signatures $S_1$ counted based on the feedback from the signature sensor 10 reaches a predetermined number, the controller 13 determines that the last signature $S_1$ for the sheet stack B has passed through the pair of conveyance rollers 40 and conveys the sheet stack B from the stacking position $P_1$. In other words, the controller 13 controls the stacking unit 5 to move the stopper 52 from the contact position to the retraction position and conveys the sheet stack B from the stacking position $P_1$ by means of rotation of the chain or belt 50.

Concurrently, when the controller 13 determines that the last signature $S_1$ has passed through the pair of conveyance rollers 40, the controller 13 switches the conveyance rollers 40 from continuous rotation to intermittent rotation. Although the first conveyance unit 3 (the pair of conveyance rollers 30) continues to sequentially convey the signatures $S_1$ for the next sheet stack B, the pair of conveyance rollers 40, by means of the intermittent rotation thereof, sequentially receive the signatures $S_1$ for the next sheet stack B and hold these signatures $S_1$ by sandwiching these signatures $S_1$ so as not to convey these signature S1 to the stacking unit 5. In this way, the pair of conveyance rollers 40 keep the signatures $S_1$ for the next sheet stack B from being conveyed to the stacking unit 5.

Alternatively, when the controller 13 determines that the last signature $S_1$ has passed through the pair of conveyance rollers 40, the controller 13 may switch the conveyance rollers 40 from the continuous rotation to stop. The pair of conveyance rollers 40, by means of the stop of rotation thereof, hold at least the first signature $S_1$ for the next sheet stack B by sandwiching the at least first signature $S_1$ such that subsequent signatures $S_1$ are placed on the at least held first signature $S_1$ in sequence. In this way, the pair of conveyance rollers 40 are also able to keep the signatures $S_1$ for the next sheet stack B from being conveyed to the stacking unit 5.

It is determined based on the detections by the first sensors 10 and 11 as described above that the last signature $S_1$ has passed through the pair of conveyance rollers 40. Therefore, the controller 13 switches the conveyance rollers 40 from the continuous rotation to the intermittent rotation or the stop at the timing determined based on the detections by the first sensors 10 and 11.

Upon completion of conveying the sheet stack B from the stacking position $P_1$, the stacking unit 5 becomes ready to receive the signatures $S_1$ for the next sheet stack B at the stacking position $P_1$.

When the controller 13 determines that the stacking unit 5 has become ready to receive the signatures $S_1$ for the next sheet stack B, the controller 13 switches the conveyance rollers 40 from the intermittent rotation or stop to the continuous rotation. In this way, the pair of conveyance rollers 40 start to convey the signatures $S_1$ to the stacking unit 5. The signatures $S_1$ for the next sheet stack B which have been kept from being conveyed are conveyed to the stacking position $P_1$ by the pair of conveyance rollers 40. The signatures $S_1$ subsequent to these are also then conveyed by the pair of conveyance rollers 40 to the stacking position $P_1$. This results in the signatures $S_1$ for the next sheet stack B being stacked at the stacking position $P_1$.

It is determined using the sensor 12 as described above that the stacking unit 5 has become ready to receive the signatures $S_1$ for the next sheet stack B. Therefore, the controller 13 switches the conveyance rollers 40 form the intermittent rotation or stop form the continuous rotation at the timing determined based on the detection by the second sensor 12.

Subsequently, this is repeated, so that the sheet stacks B are conveyed from the stacking position $P_1$ one after another. Each of the sheet stacks B is then processed by other devices (not shown) such as a saddle stitching device and a three-side trimmer.

As described above, while the stacking unit 5 is conveying the sheet stack B from the stacking position $P_1$, the stacking device 1 and the method for sorting keep the signatures $S_1$ for the next sheet stack B from being conveyed from the stacking position $P_1$ without stopping the first conveyance unit 3 from conveying the signatures $S_1$. The stacking device 1 and the method for sorting achieve this by means of switching the pair of conveyance rollers 40 (as an example of a pair of conveyance members) between the continuous rotation and the intermittent rotation or stop.

For example, the binding system disclosed in Japanese Unexamined Patent Application Publication No. 2002-200865 stacks signatures on a knife and retracts the knife using a cylinder to drop the stacked signatures onto a collating chain. Such a conventional method requires to reciprocate the knife by the stroke corresponding to the length of the signature. Therefore, it takes time to sort the signatures into the sheet stacks. In contrast, the stacking device 1 and the method for sorting in the embodiment sort the signatures $S_1$ into the sheet stacks B by only controlling the rotation of the conveyance rollers 40. This eliminates the need for displacement of the conveyance rollers 40 such as reciprocation. The stacking device 1 and the method for sorting allow for sequentially forming the sheet stacks at high speed, thereby improving the productivity of the binding system.

Some conventional methods keep signatures from being conveyed by engaging a claw with the front edges of the signatures from the inside. In such methods, the claw may be disengaged from the signatures and consequently may fail to keep the signatures from being conveyed. In contrast, the stacking device 1 and the method for sorting in the embodiment sandwich the signatures $S_1$ from the outside between the pair of conveyance rollers 40. Since the signatures $S_1$ is firmly held, the above-mentioned problem does not occur. For example, in an embodiment wherein the stacking device 1 includes a guide (not shown) for guiding the signatures $S_1$ to the pair of conveyance rollers 40, the stacking device 1 is able to reliably prevent the pair of conveyance rollers 40 from failing to receive the signatures $S_1$ and consequently dropping the signatures $S_1$.

Figure 6:
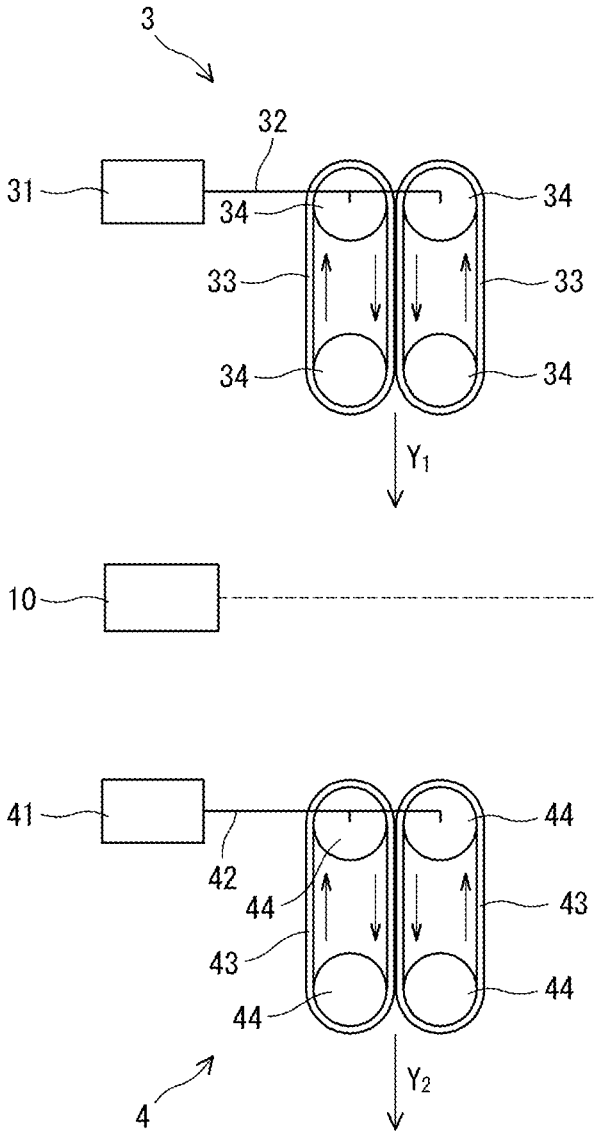
FIG. 6 is a schematic view of another exemplary stacking device.

The pair of conveyance rollers 30 or 40 is used as the pair of conveyance members in the above embodiments. Alternatively, as illustrated in FIG. 6, the pair of conveyance members may be a pair of conveyance belts 33 or 43 opposed to each other and arranged for receiving and sandwiching the signatures $S_1$ from the upstream conveyance unit 2 or first conveyance unit 3. The endless conveyance belts 33 or 43 are engaged with pulleys 34 or 34 which are arranged at intervals in the conveyance direction $Y_1$ or $Y_2$ and each is rotatable about an axis extending perpendicularly to the conveyance direction $Y_1$ or $Y_2$. In this way, the endless conveyance belts 33 or 43 extend in the conveyance direction $Y_1$ or $Y_2$. The conveyance belts 33 or 43 are driven to rotate by the motor 31 or 41 and the transmission mechanism 32 or 42. The conveyance unit 3 or 4 conveys the signatures $S_1$ in the conveyance direction $Y_1$ or $Y_2$ through the pair of conveyance belts 33 or 43 while sandwiching the signatures $S_1$ between the pair of conveyance belts 33 or 43 by means of rotation of the conveyance belts 33 or 43.

In the above embodiments, the signature sensor 10 and the mark sensor 11 are each used as the first sensor. The first sensor is not limited to the above embodiments. In a case where the controller 13 receives information, which indicates the number of signatures $S_1$ that form a sheet stack B, from a device arranged upstream of the stacking device 1 such as a sheet feeder 70 or a printer, only the signature sensor 10 may be used as the first sensor. The controller 13 is capable of determining based on the information and the detection by the sensor 10 that the last signature $S_1$ for the sheet stack B has passed through the pair of conveyance rollers 40 or 43. In this case, the mark sensor 11 and the marks M are omitted.

Figure 7:
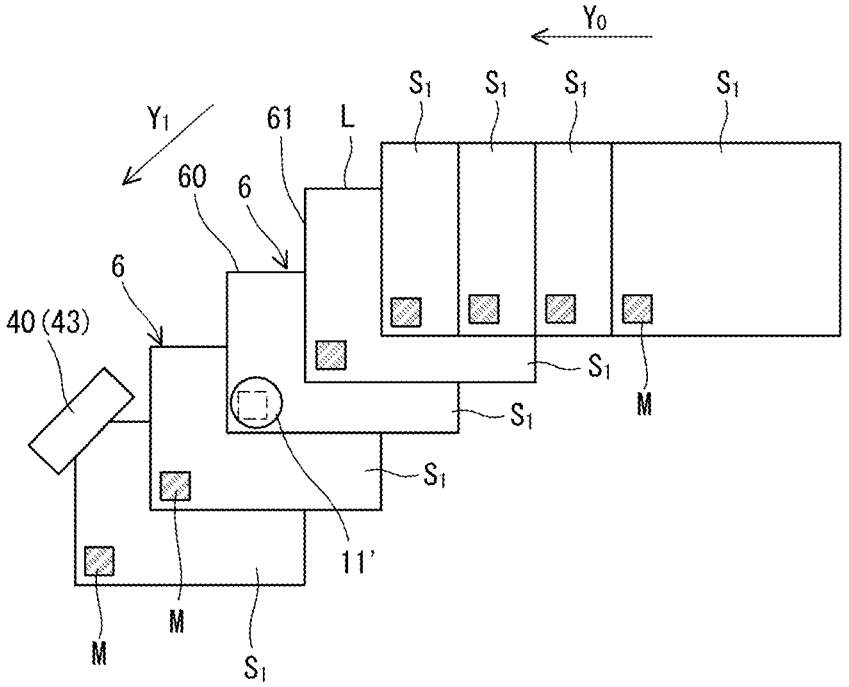
FIG. 7 illustrates another exemplary first sensor.

For example, in the embodiment illustrated in FIG. 7, marks M are provided on the signatures $S_1$ for determining the last signatures $S_1$ for the respective sheet stack B. Marks M are provided on the parts of the signatures $S_1$ which are exposed while the signatures $S_1$ are conveyed successively. In the embodiment illustrated in FIG. 7, only a mark sensor 11' is used as the first sensor. The mark sensor 11' is arranged to detect marks M at a position upstream of the pair of conveyance members 40 or 43. The controller 13 is capable of determining based on the detection by the mark sensor 11' when the last signature $S_1$ has passed through the pair of conveyance rollers 40 or 43.

In yet another embodiment, a signature sensor 10, a mark sensor 11, and an additional signature sensor (not shown) may be each used as first sensor. Marks M to be detected by the mark sensor 11 may be simple marks provided on the first or last signatures $S_1$ for the respective sheet stacks B in order to distinguish them from the other signatures $S_1$. The additional signature sensor is arranged to detect passage of the signatures $S_1$ before the signature $S_1$ (sheets $S_0$) are overlapped in order to count the number of the signatures $S_1$. The additional signature sensor is electrically connected to the controller 13. The controller 13 is capable of determining the number of the signatures $S_1$ for the respective sheet stacks B based on the detection by the mark sensor 11 and the detection by the additional signature sensor. Therefore, the controller 13 is capable of determining, based on the detections by the sensor 10, the additional sensor 11 and the further additional sensor, that the last signature $S_1$ for the sheet stack B has passed through the pair of conveyance rollers 40.

In the above embodiments, the second sensor 12 is the encoder but is not limited to this. The second sensor 12 is selected as appropriate for the structure of the stacking unit 5. A plurality of sensors may be each used as the second sensor 12.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A stacking device for stacking signatures, comprising:

a first conveyance unit configured to sequentially convey the signatures, which are folded sheets;

a second conveyance unit comprising a pair of conveyance members arranged for receiving the signatures from the first conveyance unit, at least one of the conveyance members being configured to be driven to rotate, the second conveyance unit being configured to convey the signatures through the pair of conveyance members by means of rotation of the pair of conveyance members while sandwiching both sides of the signatures between the pair of conveyance members;

a stacking unit configured to stack the signatures conveyed from the second conveyance unit;

a first sensor configured to detect the signatures that have passed through the pair of conveyance members;

a second sensor configured to detect when the stacking unit is ready to receive the signatures; and a controller configured to control rotation of the at least one of the conveyance members based on a feedback from the first sensor and a feedback from the second sensor, wherein, when it is determined based on the feedback from the first sensor that a predetermined number of the signatures have passed the pair of conveyance members, the controller is configured to switch the conveyance members from continuous rotation to intermittent rotation or stop, wherein, when the conveyance members are in intermittent rotation or stopped, the controller is configured to convey the signatures stacked in the stacking unit, wherein, when the conveyance members are in intermittent rotation or stopped, and when it is determined based on the feedback from the second sensor that the stacking unit is ready to receive the signatures, the controller is configured to switch the conveyance members from the intermittent rotation or stop to the continuous rotation, and wherein the first conveyance unit continues to sequentially convey the signatures while the conveyance members of the second conveyance unit are in a state of the intermittent rotation or stop.

2. The stacking device according to claim 1, wherein the pair of conveyance members is a pair of conveyance rollers or a pair of conveyance belts.

3. The stacking device according to claim 1, wherein the first sensor comprises:

a signature sensor arranged to detect passage of the signatures downstream of the first conveyance unit and upstream of the second conveyance unit; and a mark sensor arranged to detect marks on the signatures at a position upstream of the first conveyance unit.

4. The stacking device according to claim 1, wherein the first sensor comprises a mark sensor arranged to detect marks on the signatures upstream of the pair of conveyance rollers.

5. The stacking device according to claim 1, wherein the first conveyance unit is configured to convey the signatures diagonally downwards with a fold line of each of the signatures oriented upward.

6. The stacking device according to claim 5, wherein the second conveyance unit is further configured to covey the signatures diagonally downwards.

7. The stacking device according to claim 1, wherein the stacking unit comprises a continuous chain or belt extending across a stacking position and defining a conveyance path for the sheet stacks, wherein the signatures are conveyed from the second conveyance unit to the stacking position to be stacked on the endless chain or belt in a straddling manner, and wherein the sheet stack is conveyed along the conveyance path by means of rotation of the endless chain or belt in a straddling state.

8. The stacking device according to claim 7, wherein the second sensor comprises a sensor arranged to detect rotation of the continuous chain or belt.

9. The stacking device according to claim 1, further comprising a pair of fold rollers configured to form the signatures by folding each of sheets along a crease, wherein the first conveyance unit comprises a pair of conveyance rollers arranged for receiving the signatures from the pair of fold rollers.

10. The stacking device according to claim 1, wherein the first conveyance unit comprises a pair of conveyance rollers configured to convey the signatures diagonally downwards with a fold line of each of the signatures oriented upward, and wherein the first sensor comprises a signature sensor arranged to detect passage of the signatures at positions where steps pass, each step being formed by an upper edge of a first signature conveyed by the pair of conveyance rollers diagonally downwards and a front edge of a second signature next to the first signature.

11. A method for sorting signatures into sheet stacks, wherein the signatures, which are folded sheets, are sequentially conveyed by a first conveyance unit to a second conveyance unit comprising a pair of conveyance members at least one which is configured to be driven to rotate, the method comprising:

sequentially conveying the signatures through the pair of conveyance members to a stacking unit while sandwiching the signatures between the pair of conveyance members by means of continuous rotation of the conveyance members;

in response to passage of a last signature for a sheet stack through the pair of conveyance members, switching the conveyance members from the continuous rotation to intermittent rotation or stop to cause the pair of conveyance members to keep the signatures for a next sheet stack from being conveyed to the stacking unit;

in response to the stacking unit becoming ready to receive the signatures for a next sheet stack, switching the conveyance members from the intermittent rotation or stop to the continuous rotation to cause the pair of conveyance members to convey the signature for the next sheet stack to the stacking unit; and continuing to sequentially convey the signatures while the conveyance members are in a state of the intermittent rotation or stop.

12. The method according to claim 11, comprising, in response to the passage of the last signature for the sheet stack through the pair of conveyance members, switching the conveyance members from the continuous rotation to the intermittent rotation to cause the pair of conveyance members to, by means of the intermittent rotation, receive the signatures for the next sheet stack from the first conveyance unit and to hold the signatures for the next sheet stack by sandwiching the signatures for the next sheet stack so as to keep the signatures for the next sheet stack from being conveyed to the stacking device.

13. The method according to claim 11, comprising, in response to determining that the last signature for the next sheet stack has passed through the pair of conveyance members, switching the conveyance members from the continuous rotation to the stop to cause the pair of conveyance members to, by means of the stop of rotation, hold at least first signature for the next sheet stack by sandwiching the at least first signature such that subsequent signatures are placed on the at least held first signature.

14. The method according to claim 11, wherein a pair of conveyance rollers or a pair of conveyance belts is used as the pair of conveyance rollers.

15. A stacking device for stacking signatures, comprising:

a first conveyance unit configured to sequentially convey the signatures, which are folded sheets;

a second conveyance unit comprising a pair of conveyance members arranged for receiving the signatures from the first conveyance unit, at least one of the conveyance members being configured to be driven to rotate, the second conveyance unit being configured to convey the signatures through the pair of conveyance members by means of rotation of the pair of conveyance members while sandwiching both sides of the signatures between the pair of conveyance members;

a stacking unit configured to stack the signatures conveyed from the second conveyance unit;

a first sensor configured to detect the signatures that have passed through the pair of conveyance members;

a second sensor configured to detect when the stacking unit is ready to receive the signatures; and a controller configured to control rotation of the at least one of the conveyance members based on a feedback from the first sensor and a feedback from the second sensor, wherein, when it is determined based on the feedback from the first sensor that a predetermined number of the signatures have passed the pair of conveyance members, the controller is configured to switch the conveyance members from continuous rotation to intermittent rotation or stop, wherein, when the conveyance members are in intermittent rotation or stopped, the controller is configured to convey the signatures stacked in the stacking unit, wherein, when the conveyance members are in intermittent rotation or stopped, and when it is determined based on the feedback from the second sensor that the stacking unit is ready to receive the signatures, the controller is configured to switch the conveyance members from the intermittent rotation or stop to the continuous rotation, and wherein the first sensor comprises a signature sensor arranged to detect passage of the signatures downstream of the first conveyance unit and upstream of the second conveyance unit.

* * * * *